US008534203B2

(12) United States Patent
Dalske et al.

(10) Patent No.: US 8,534,203 B2
(45) Date of Patent: Sep. 17, 2013

(54) SUPPORT SYSTEM FOR A RAILCAR AND METHOD FOR ASSEMBLING THE SAME

(75) Inventors: Roger Dalske, Florissant, MO (US); Joseph R. Silverio, St. Peters, MO (US); Domela Silverio, legal representative, St. Peters, MO (US); Spencer Ashie-Winns, St. Charles, MO (US); Gerald Ohmes, Wentzville, MO (US); Ike Portscheller, Wildwood, MO (US)

(73) Assignee: American Railcar Industries, Inc., St. Charles, MO (US)

( * ) Notice: Subject to any disclaimer, the term of this patent is extended or adjusted under 35 U.S.C. 154(b) by 239 days.

(21) Appl. No.: 13/022,459

(22) Filed: Feb. 7, 2011

(65) Prior Publication Data

US 2012/0199042 A1 Aug. 9, 2012

(51) Int. Cl.
*B61D 3/00* (2006.01)

(52) U.S. Cl.
USPC ..... 105/248; 105/247

(58) Field of Classification Search
USPC ..... 105/247, 248, 249, 250, 253, 254, 105/255
See application file for complete search history.

(56) References Cited

U.S. PATENT DOCUMENTS 3,584,564 A * 6/1971 Rollins ..... 454/91
4,352,331 A * 10/1982 Anderson et al. ..... 105/248
4,377,058 A * 3/1983 Hallam et al. ..... 52/45
4,444,123 A * 4/1984 Smith et al. ..... 105/377.01
4,455,947 A * 6/1984 Reeve et al. ..... 105/377.01
RE32,189 E * 6/1986 Adler et al. ..... 105/377.07
4,898,101 A * 2/1990 Harter ..... 105/247
4,941,411 A * 7/1990 Wong ..... 105/421
5,259,322 A * 11/1993 Dominguez et al. ..... 105/4.1
6,164,210 A * 12/2000 Coslovi et al. ..... 105/396
6,237,505 B1 * 5/2001 Sande et al. ..... 105/248
6,244,191 B1 * 6/2001 Lydic ..... 105/377.07
6,502,518 B1 * 1/2003 Miller ..... 105/248
7,784,411 B2 * 8/2010 Forbes ..... 105/406.1
7,908,975 B2 * 3/2011 Forbes ..... 105/248
2007/0277696 A1 * 12/2007 Forbes ..... 105/406.1
2008/0035014 A1 * 2/2008 Gillis et al. ..... 105/248
2009/0120323 A1 * 5/2009 Forbes ..... 105/248
2010/0011987 A1 * 1/2010 Forbes ..... 105/406.1
2010/0319570 A1 * 12/2010 Forbes et al. ..... 105/248
2012/0199042 A1 * 8/2012 Dalske et al. ..... 105/248

* cited by examiner

*Primary Examiner* — Jason C Smith
(74) *Attorney, Agent, or Firm* — Armstrong Teasdale LLP

(57) ABSTRACT

A railway hopper car is provided. The railway hopper car includes an upper portion and a lower portion. The upper portion includes first and second sidewalls, and first and second end walls. The lower portion includes at least two cargo wells and a longitudinal boundary extending between the cargo wells. The upper and lower portions define an interior volume of the hopper car. The railway hopper car further includes a roof panel and a first support assembly. The roof panel includes an access opening extending longitudinally over at least a portion of the cargo wells. The first support assembly is coupled to an inner surface of the first sidewall, and extends between a top edge and a bottom edge of the first sidewall. The first support assembly is positioned proximate to the longitudinal boundary, and is configured to only partially extend into the interior volume of the hopper car.

34 Claims, 9 Drawing Sheets

SUPPORT SYSTEM FOR A RAILCAR AND METHOD FOR ASSEMBLING THE SAME

BACKGROUND OF THE INVENTION

The embodiments described herein relate generally to support systems for railcars and, more particularly, to an internal support system for a railway hopper car that allows a loading arm to freely move within the hopper car from hopper compartment to hopper compartment for most of the length of the hopper car.

Railroad cars generally have one or more compartments for storing and transporting materials. At least some known railroad cars include roof panels that include one or more access openings or hatch ports. Hatch ports are provided for loading the compartment with product and are usually located at the top of the compartment defined in the roof panel. Hatch ports usually have an elongated elliptical cross-sectional shape and are frequently provided with a collar extending outwardly about the periphery of the hatch port. A hatch cover is provided to close or seal the hatch port.

Known railroad cars generally include bulkheads positioned within the railroad car to separate compartments and to provide structural support to an outer shell of the compartment. Hatch ports are positioned between the bulkheads for loading and unloading a respective compartment. With respect to loading at least some known railcars, a worker will insert a loading arm into an open hatch port. Material will be pumped or transported through the loading arm into the hopper compartment. When the corresponding hopper compartment is full, the loading arm is removed an then inserted into the next open hatch port so the next hopper compartment can be filled. With respect to at least some known railroad cars, a worker inserts a probe through the hatch port and into the compartment to facilitate unloading the materials through the bottom of the compartment. The probe is used to breakup the material to get it to flow out the bottom opening. The worker inserts the probe into each compartment separately, which increases the time spent unloading the railroad car. Additionally, as the probe is inserted and removed through each hatch port for unloading, the hatch port, bulkhead, and compartment shell may become damaged as the probe moves about the compartment to unload the materials. A system is needed that facilitates loading and unloading a hopper car. Specifically, an internal support structure is needed to allow a loading arm and unloading probe to move unimpeded from one hopper compartment to another.

BRIEF DESCRIPTION OF THE INVENTION

In one aspect, a method of assembling a railway hopper car is provided. The method includes coupling first and second opposing sidewalls extending in a longitudinal direction to first and second opposing end walls extending in a transverse direction to form an upper portion of the hopper car wherein the sidewalls and the end walls include a top edge and a bottom edge, and coupling a plurality of well panels to the upper portion of the hopper car for forming a lower portion of the hopper car. The lower portion includes a plurality of cargo wells. Each of the well panels sloping inwardly from the bottom edge of the upper portion to a selectively openable floor. Each cargo well of the plurality of cargo wells including at least one longitudinal boundary extending in the transverse direction and defined by an intersection of two well panels. The method further includes coupling a roof panel proximate to the top edge of the sidewalls and the end walls wherein the roof panel includes an access opening extending longitudinally over at least a portion of each of the plurality of cargo wells, and coupling a first support assembly to an inner surface of the first sidewall and a second support assembly to an inner surface of the second sidewall proximate to a first longitudinal boundary of the at least one longitudinal boundary, each support assembly extending between the roof panel and the bottom edge of the sidewalls, wherein the first support assembly is separate from the second support assembly.

In another aspect, a support system for a railway hopper car is provided. The railway hopper car includes an upper portion, a lower portion coupled to the upper portion, and a roof panel coupled to a top section of the upper portion. The upper portion includes a first sidewall and an opposing second sidewall extending in the longitudinal direction. The first and second sidewalls are coupled between a first end wall and an opposing second end wall wherein the first and second end walls extend in the transverse direction. The lower portion includes a plurality of cargo wells including a plurality of inwardly sloping well panels, each cargo well of the plurality of cargo wells including at least one longitudinal boundary extending in the transverse direction and defined by the intersection of two well panels. The roof panel includes an access opening extending longitudinally over at least a portion of each of the plurality of cargo wells. The support system includes a first support assembly coupled to an inner surface of the first sidewall of the hopper car, and a second support assembly coupled opposite said first support assembly to an inner surface of the second sidewall of the hopper car, wherein the first support assembly and the second support assembly are separate from one another.

In another aspect, a railway hopper car is provided. The railway hopper car includes a first sidewall and a second opposing sidewall coupled between a first end wall and a second opposing end wall to form an upper portion of the hopper car. The first and second sidewalls extend in a longitudinal direction, and the first and second opposing end walls extend in a transverse direction. The sidewalls and the end walls include a top edge and a bottom edge. The railway hopper car further includes a plurality of cargo wells coupled together to form a lower portion of the hopper car. The upper portion is coupled to the lower portion to form the hopper car, each cargo well of the plurality of cargo wells comprises a plurality of well panels sloping inwardly from the bottom edge of the upper portion to a selectively openable floor. Each cargo well of the plurality of cargo wells includes at least one longitudinal boundary extending in the transverse direction and defined by an intersection of two well panels. The railway hopper car also includes a roof panel coupled to the top edge of the sidewalls and the end walls wherein the roof panel includes an access opening extending longitudinally over at least a portion of each of the plurality of cargo wells, at least one first support assembly coupled to an inner surface of said first sidewall wherein each of the at least one first support assembly extends between the top edge and the bottom edge of the first sidewall, and at least one second support assembly coupled to an inner surface of the second sidewall. Each of the at least one second support assembly extends between the top edge and the bottom edge of the second sidewall. The second support assembly is separate from the first support assembly.

In another aspect, a railway hopper car is provided. The railway hopper car includes an upper portion and a lower portion. The upper portion includes a first sidewall, an opposing second sidewall, a first end wall, and an opposing second end wall. The lower portion is coupled to the upper portion, and includes at least two cargo wells and a longitudinal boundary extending between the at least two cargo wells. Each cargo well includes a selectively openable floor. The upper and lower portions define an interior volume of the hopper car. The railway hopper car further includes a roof panel coupled to a top edge of the sidewalls and the end walls wherein the roof panel includes an access opening extending longitudinally over at least a portion of the at least two cargo wells, and a first support assembly coupled to an inner surface of the first sidewall. The first support assembly extends between the top edge and a bottom edge of the first sidewall. The first support assembly is positioned proximate to the longitudinal boundary, and is configured to only partially extend into the interior volume of the hopper car.

BRIEF DESCRIPTION OF THE DRAWINGS

FIG. 1 is a side view of an exemplary railway hopper car having a support system in accordance with the present invention.

FIG. 2 is a top view of the railway hopper car shown in FIG. 1 with each hatch cover in a closed position.

FIG. 3 is a top view of the railway hopper car shown in FIG. 1 with the hatch covers and walkway removed.

FIG. 4 is a cross-sectional view of the railway hopper car shown in FIG. 1 with an exemplary embodiment of the support system.

FIG. 5 is a partial cross-sectional view of the exemplary support system that may be used with the railway hopper car shown in FIG. 1.

FIG. 6 is a perspective view of the exemplary top gusset panel shown in FIG. 4.

FIG. 7 is a perspective view of the exemplary bottom gusset panel shown in FIG. 4.

FIG. 8 is a partial cross-sectional view of the support assembly shown in FIG. 4.

FIG. 9 is a perspective view of the support assembly shown in FIG. 4.

DETAILED DESCRIPTION OF THE INVENTION

The embodiments of a support system for use with a railway hopper car are described herein. The support system enables an operator to manipulate a probe or loading arm from one hopper compartment to another hopper compartment for most of the length of the hopper car. More specifically, by including a support system that defines a roof access opening extending across multiple hopper compartments, the embodiments described herein facilitate assembling a railcar having an internal volume that extends mostly unimpeded across multiple hopper compartments for most of the length of the railcar. Moreover, the embodiments described herein include a support system that includes separate support assemblies coupled to an inside surface of opposing railcar sidewalls. Such support assemblies allow the operator to manipulate a probe or loading arm through each hopper compartment without requiring the probe or loading arm being removed from the railcar when moved from one compartment to an adjacent compartment, reducing time and cost associated with loading and unloading material and reducing damage to the railcar.

Figure 1:
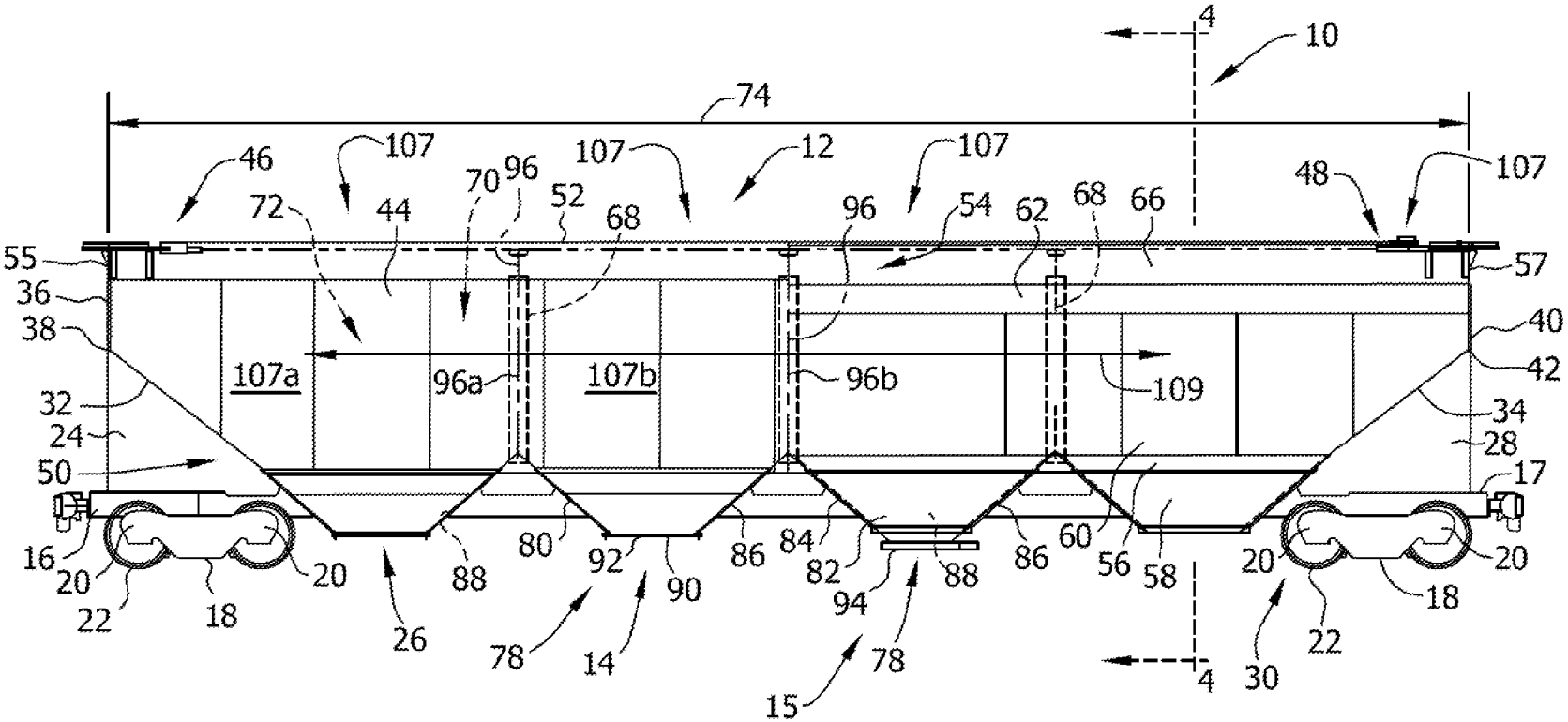
FIGS. 1-9 show exemplary embodiments of the apparatus described herein.
Figure 2:
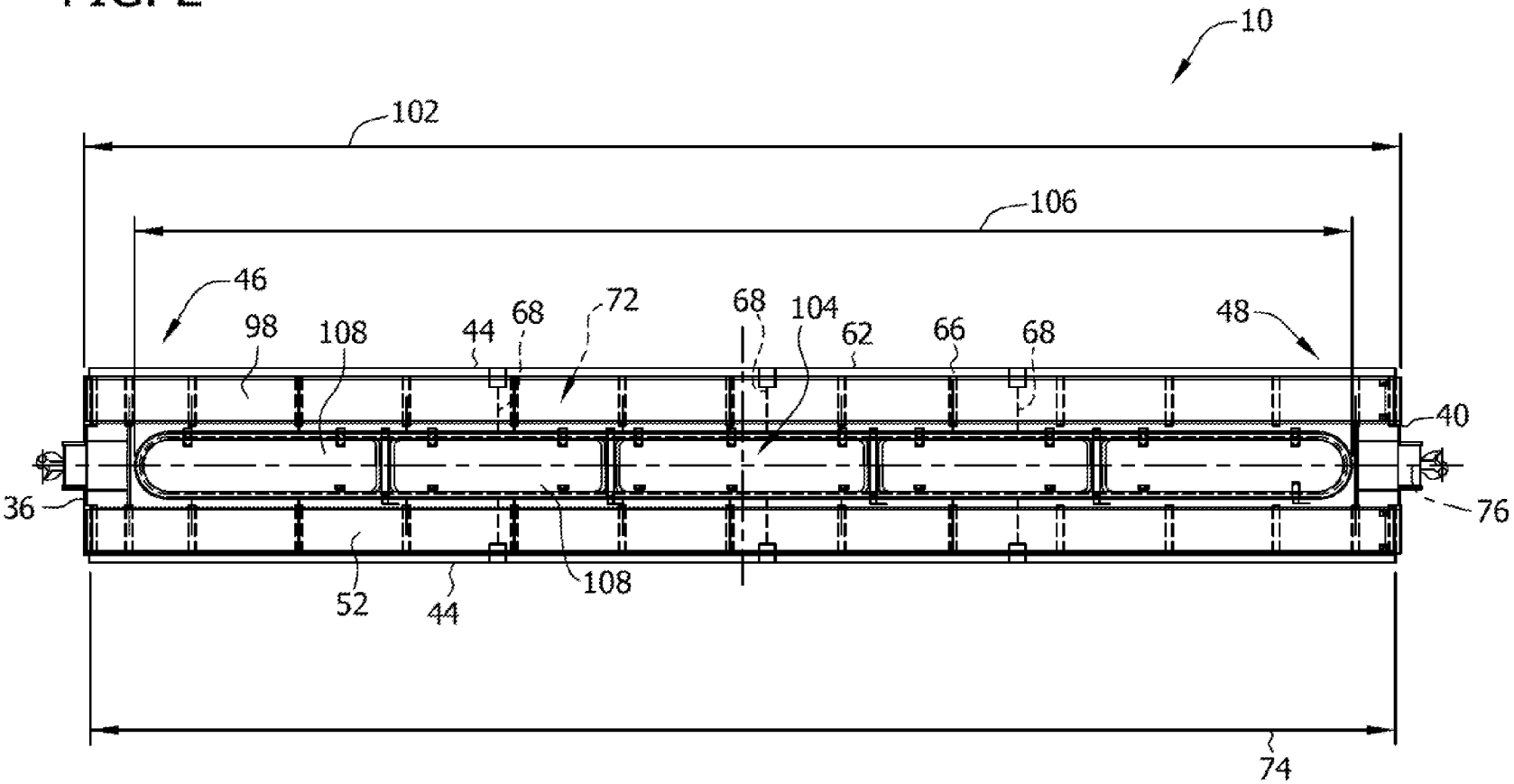

FIG. 1 is a side view of an exemplary railway hopper car 10 having an exemplary embodiment of the support system. FIG. 2 is a top view of railway hopper car 10 shown in FIG. 1. Identical components shown in FIG. 2 are labeled with the same reference numbers used in FIG. 1. Railway hopper car 10 can be used to store and/or transport materials, such as dried distillers grains, dried distillers grains with solubles, and/or any other suitable granular or flowable material. In the exemplary embodiment, railway hopper car 10 is configured to withstand a pressure of between about 0.25 pounds per square inch (psi) and about 15 psi.

In the exemplary embodiment, railway hopper car 10 includes an upper portion 12 coupled to a lower portion 14. Lower portion 14 includes a cargo assembly 15 extending between a front sill assembly 16, and a rear sill assembly 17. Each sill assembly 16 and 17 includes a truck 18 having a pair of axles 20 each coupled to a pair of wheels 22. Upper portion 12 includes a front end structure 24, a rear end structure 28, and two opposing sidewalls 44 extending therebetween. Front end structure 24 includes a front sloped sheet 32 coupled to a first or front end wall 36. Front sloped sheet 32 extends obliquely inwardly from first end wall 36 towards rear end structure 28. Rear end structure 28 includes a rear sloped sheet 34 coupled to a second or rear end wall 40. Rear sloped sheet 34 extends obliquely inwardly from second end wall 40 towards front end structure 24. Front end structure 24 is coupled to front sill assembly 16 and to a forward portion 26 of cargo assembly 15. Rear end structure 28 is coupled to rear sill assembly 17 and to a rear portion 30 of cargo assembly 15. Sidewalls 44 are coupled between first end wall 36 and second end wall 40. A forward section 46 of sidewalls 44 is coupled to first end wall 36 and to front sloped sheet 32. A rearward section 48 of sidewalls 44 is coupled to rear end wall 40 and to rear sloped sheet 34. A bottom section 50 of sidewalls 44 is coupled to cargo assembly 15.

A roof assembly 52 is coupled to a top section 54 of sidewalls 44 such that sidewalls 44 extend between roof assembly 52 and cargo assembly 15. Roof assembly 52 is further coupled to a top 55 of first end wall 36 and a top 57 of second end wall 40. In an alternative embodiment, roof assembly 52, sidewalls 44, first end wall 36 and second end wall 40 are formed integrally to form upper portion 12. In the exemplary embodiment, at least one sill 56 is coupled to an outer surface 58 of cargo assembly 15 and an outer surface 60 of sidewalls 44. Sill 56 extends between front end structure 24 and rear end structure 28. At least one chord beam 62 extends between first end wall 36 and second end wall 40 and is coupled to an outer surface 66 of roof assembly 52 and to sidewall outer surface 60. At least one support system 68 is coupled to an inner surface 70 of sidewalls 44 and extends between roof assembly 52 and cargo assembly 15. Sidewalls 44, roof assembly 52, cargo assembly 15, and support system 68 together define an interior volume 72 extending between first end wall 36 and second end wall 40. Interior volume 72 includes a length 74 extending along a longitudinal axis 76 of railway hopper car 10.

Cargo assembly 15 includes a plurality of cargo wells 78 that include at least one well panel 80. In the exemplary embodiment, each cargo well 78 includes two opposing side well panels 82, a front well panel 84, and a rear well panel 86. Side well panels 82 are coupled between front well panel 84 and rear well panel 86 to form cargo well 78. Side well panels 82, front well panel 84, and rear well panel 86 each include a downwardly and/or inwardly sloping inner surface 88 to form cargo well 78 having a trapezoidal shape. In an alternative embodiment, cargo well 78 is formed having a conical shape. An opening 90 extends through an outer surface 92 of cargo well 78 such that interior volume 72 is accessible through opening 90. A hatch 94 is removably coupled to cargo well 78 and is sized to at least partially cover opening 90. In the exemplary embodiment, cargo assembly 15 includes a plurality of cargo wells 78 each coupled to an adjacent cargo well 78 such that cargo assembly 15 extends along longitudinal axis 76 between front end structure 24 and rear end structure 28. Front well panel 84 is coupled to an adjacent rear well panel 86 to form at least one longitudinal boundary 96 between adjacent cargo wells 78 at the intersection of front well panel 84 and rear well panel 86. In an alternative embodiment, a connecting panel (not shown) is coupled between front well panel 84 and rear well panel 86 to form longitudinal boundary 96. As explained below, support systems 68 (See FIG. 1) are positioned at longitudinal boundary 96.

In the exemplary embodiment, roof assembly 52 includes at least one roof panel 98 coupled between first end wall 36 and second end wall 40. Roof panel 98 extends a length 102 measured along longitudinal axis 76 between first end wall 36 and second end wall 40. Roof panel 98 includes an access opening 104 extending through roof panel 98 such that interior volume 72 is accessible through roof access opening 104. Roof access opening 104 extends between first end wall 36 and second end wall 40 over at least a portion of the plurality of cargo wells 78. Roof access opening 104 includes a length 106 measured along longitudinal axis 76. In the exemplary embodiment, roof opening length 106 is greater than about one half of length 102 of roof panel 98. In an alternative embodiment, roof opening length 106 is equal to about one half of length 102, or is less than one half of length 102. Roof assembly 52 includes at least one roof hatch 108 that at least partially covers roof access opening 104. Roof hatch 108 is removably coupled to roof outer surface 66 and is configured to selectively cover roof access opening 104. In one embodiment, roof assembly 52 includes a plurality of roof hatches 108 that each at least partially cover a portion of roof access opening 104.

Hopper car 10 is divided into a plurality of hopper compartments 107. Each hopper compartment 107 is at least partially defined by a portion of sidewalls 44, a portion of roof panel 98, a respective cargo well 78, and at least one longitudinal boundary 96. More specifically, in the exemplary embodiment, a first hopper compartment 107*a* is at least partially defined by a portion of sidewalls 44, first end wall 36, a portion of roof panel 98, a first cargo well 78*a*, and a first longitudinal boundary 96*a*. Further, a second hopper compartment 107*b* is at least partially defined by a portion of sidewalls 44, a portion of roof panel 98, a second cargo well 78*b*, and first longitudinal boundary 96*a*. In a particular embodiment, second hopper compartment 107*b* is further defined by a second longitudinal boundary 96*b* or second end wall 40. Interior volume 72 extends continuously from first hopper compartment 107*a* to second hopper compartment 107*b*. Moreover, a passageway 109 is defined through interior volume 72 and is at least partially defined by support system 68. Passageway 109 extends between at least first hopper compartment 107*a* and second hopper compartment 107*b*.

Figure 3:
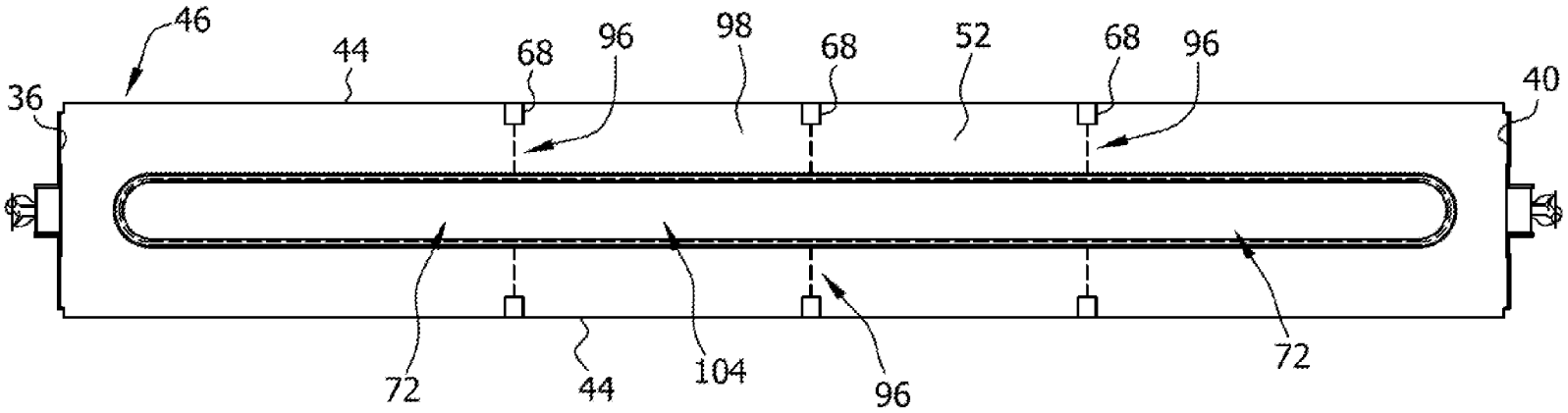

FIG. 3 is a top view of railway hopper car 10 shown in FIG. 1 with each roof hatch 108 removed from roof panel 98 and with a walkway removed from around access opening 104. In the exemplary embodiment, support system 68 is coupled to sidewalls 44 such that support system 68 does not extend into interior volume 72 directly below access opening 104. Rather, interior volume 72 extends unimpeded from roof access opening 104 to lower portion 14, and extends across longitudinal boundaries 96 and across a portion of each cargo well 78. Support systems 68 provide the required reinforcing structural support for hopper car 10. During loading of railway hopper car 10, an operator inserts a loading arm into interior volume 72 through roof access opening 104 and manipulates the loading arm across each cargo well 78 through the full longitudinal length of access opening 104 without removing the loading arm from interior volume 72 as the loading arm crosses each longitudinal boundary 96. Similarly, during unloading of railway hopper car 10, the operator manipulates a probe through interior volume 72 across each cargo well 78 without removing the probe from the railway hopper car 10 when moving the probe across each longitudinal boundary 96.

To manufacture railway hopper car 10 having support system 68, cargo assembly 15, roof assembly 52, support system 68, end structures 24 and 28, and sill assemblies 16 and 17 are assembled. More specifically, cargo assembly 15 is welded to end structures 24 and 28 and sill assemblies 16 and 17 are welded to cargo assembly 15. Cargo assembly 15, end structures 24 and 28, and sill assemblies 16 and 17 are then rested on trucks 18. Support systems 68 are welded to cargo assembly 15. Sidewalls 44 and sills 56 are welded to support system 68 and cargo assembly 15. Roof assembly 52 and chord beam 62 are welded to support system 68 and to sidewalls 44 to define interior volume 72 extending between roof assembly 52, sidewalls 44, and end structures 24 and 28. Access opening 104 is formed through roof assembly 52 to define interior volume 72 extending from roof access opening 104 to cargo assembly 15. Support systems 68 are positioned such that interior volume 72 extends unimpeded and continuously across at least a portion of each cargo well 78 of cargo assembly 15, and across each longitudinal boundary 96.

Figure 4:
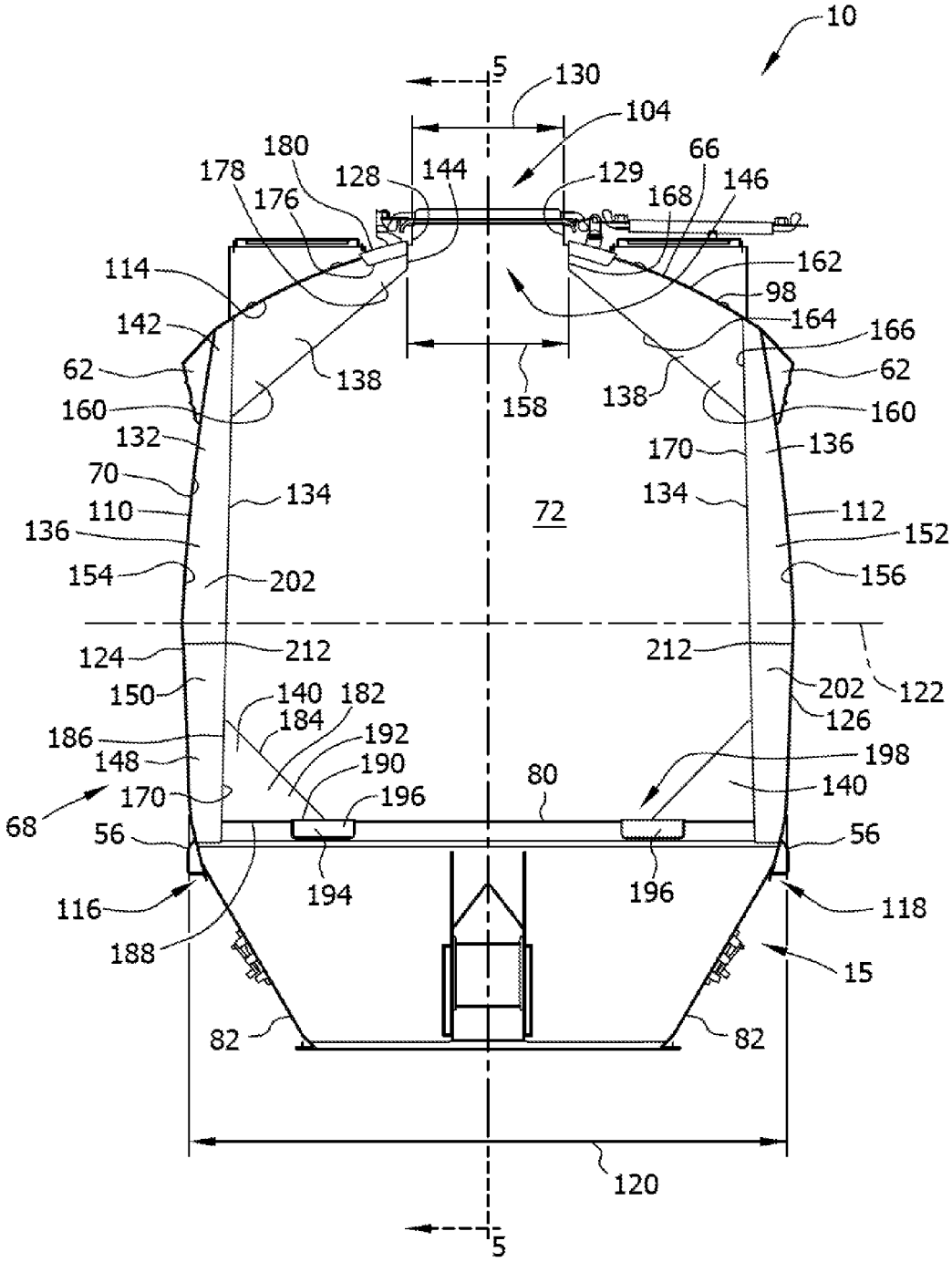
Figure 5:
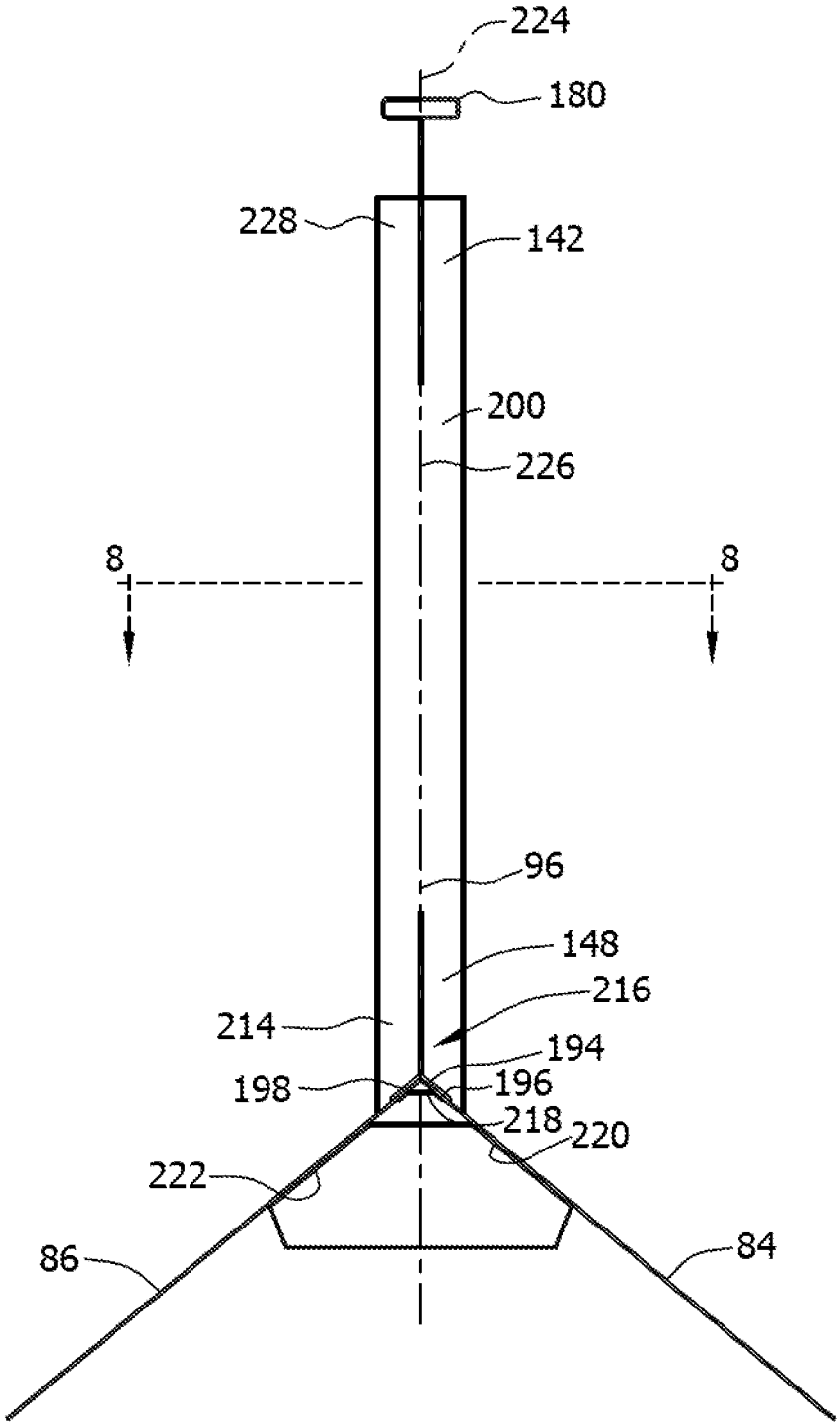

FIG. 4 is a cross-sectional view of railway hopper car 10 along sectional line 4-4 shown in FIG. 1. FIG. 5 is a partial cross-sectional view of support system 68 along sectional line 5-5 in FIG. 4. Identical components shown in FIG. 4 and FIG. 5 are labeled with the same reference numbers used in FIG. 1 and FIG. 2. In the exemplary embodiment, sidewalls 44 of railway hopper car 10 include a first sidewall 110 and a second sidewall 112. First sidewall 110 is coupled between an inner surface 114 of roof panel 98 and a first outer portion 116 of cargo assembly 15. Second sidewall 112 is coupled between inner surface 114 and a second outer portion 118 of cargo assembly 15 such that cargo assembly 15 extends between first sidewall 110 and second sidewall 112. In the exemplary embodiment, railway hopper car 10 includes a width 120 measured along a transverse axis 122 defined between an outer surface 124 of first sidewall 110 and an outer surface 126 of second sidewall 112. Roof panel 98 includes a first side 128 and a second side 129 that define roof access opening 104 extending between inner surface 114 and outer surface 66 of roof panel 98. Roof access opening 104 has a transverse width 130 measured along a transverse axis 122. In the exemplary embodiment, transverse width 130 is between about 24 inches and about 30 inches. In an alternative embodiment, transverse width 130 can be less than 24 inches or more than 30 inches.

In the exemplary embodiment, support system 68 includes at least one support assembly 132. Support assembly 132 is coupled to sidewall inner surface 70 and extends between roof panel 98 and cargo assembly 15. Support assembly 132 includes an inner surface 134 that at least partially defines interior volume 72, which extends between first end wall 36 to second end wall 40 (shown in FIG. 1) and between roof access opening 104 to a cargo assembly well panel 80. Interior volume 72 extends below roof access opening 104 through the full longitudinal length 106 of roof access opening 104 to facilitate accessing interior volume 72 from roof access opening 104.

In the exemplary embodiment, support assembly 132 includes a support member 136, a top gusset panel 138, and a bottom gusset panel 140. Support member 136 is coupled to sidewall inner surface 70 and extends between roof panel inner surface 114 and well panel 80. Top gusset panel 138 extends inwardly (toward the longitudinal middle) from an upper portion 142 of support member 136 towards roof access opening 104 and is coupled to roof panel inner surface 114. Top gusset panel 138 includes an end surface 144 that at least partially defines a cooperative opening 146 extending from interior volume 72 to roof access opening 104. Cooperative opening 146 is configured to facilitate accessing interior volume 72 from roof access opening 104 along longitudinal length 106 of roof access opening 104. Bottom gusset panel 140 extends inwardly from a lower portion 148 of support member 136. Bottom gusset panel 140 is coupled between support member 136 and cargo assembly 15.

In the exemplary embodiment, each support system 68 includes a first support assembly 150 and a separate opposite second support assembly 152. Support assemblies 150 and 152 are specific support assemblies 132. Second support assembly 152 is substantially similar to first support assembly 150. First support assembly 150 and second support assembly 152 each include support member 136, top gusset panel 138, and bottom gusset panel 140. First support assembly 150 is coupled to an inner surface 154 of first sidewall 110. Second support assembly 152 is coupled to an inner surface 156 of second sidewall 112. Inner surface 70 includes inner surfaces 154 and 156. In one embodiment, second support assembly 152 is aligned substantially planar with first support assembly 150. First support assembly 150 and second support assembly 152 each include inner surface 134 that defines interior volume 72 extending between first end wall 36 and second end wall 40, and extending between roof access opening 104 and cargo assembly 15. Support assemblies 150 and 152 at least partially define passageway 109. First support assembly 150 and second support assembly 152 further define cooperative opening 146 having a transverse width 158 that is substantially equal to roof opening transverse width 130 such that cooperative opening 146 extends between interior volume 72 and roof access opening 104. In one embodiment, no portion of either support assembly 150 and/or 152 extends below access opening 104.

In the exemplary embodiment, top gusset panel 138 of first support assembly 150 extends inwardly from support member 136 towards first side 128 of roof access opening 104. Top gusset panel 138 of second support assembly 152 extends inwardly from support member 136 towards second side 129 of roof access opening 104. In one embodiment, top gusset panel 138 of first support assembly 150 is positioned a distance from first side 128 such that top gusset panel 138 of first support assembly 150 does not extend into interior volume 72 defined below roof access opening 104. Top gusset panel 138 of second support assembly 152 is positioned a distance from second side 129 such that top gusset panel 138 of second support assembly 152 does not extend into interior volume 72 defined below roof access opening 104.

Figure 6:
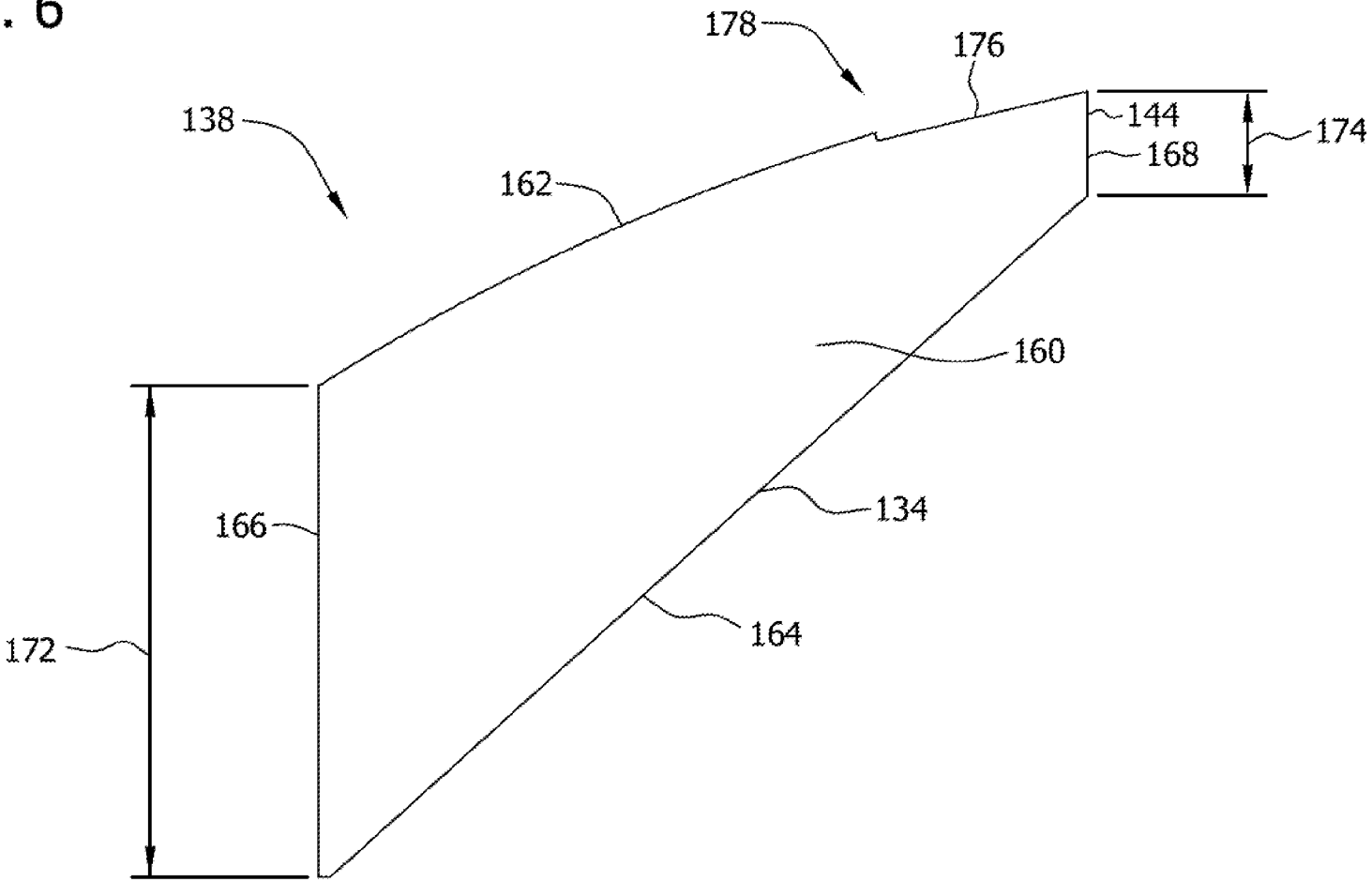

FIG. 6 is a perspective view of top gusset panel 138 shown in FIG. 4. Identical components shown in FIG. 6 are labeled with the same reference numbers used in FIG. 4. Referring to FIG. 4 and FIG. 6, in the exemplary embodiment, top gusset panel 138 includes a gusset sidewall 160 that extends between a top surface 162, an opposite bottom surface 164, and between a first end 166 and an opposite second end 168. First end 166 is coupled to an outer surface 170 of support member 136. Second end 168 extends inwardly from first end 166 and includes end surface 144 positioned adjacent roof access opening 104 to define cooperative opening 146. Bottom surface 164 extends obliquely from first end 166 towards second end 168 such that end surface 144 is at least partially positioned above support member upper portion 142. In one embodiment, first end 166 includes a first length 172 that is greater than a second length 174 of second end 168. In the exemplary embodiment, top surface 162 extends between first end 166 and second end 168, and includes an arcuate shape. Roof panel 98 is coupled to top surface 162 such that roof panel inner surface 114 includes a concave shape extending between first sidewall 110 and second sidewall 112. Bottom surface 164 and end surface 144 at least partially define inner surface 134 of support assembly 132. Top surface 162 includes a recessed groove 176 defined in an outer portion 178 of gusset sidewall 160. Recessed groove 176 is sized to receive a roof support plate 180 coupled between roof panel inner surface 114 and top surface 162 to facilitate coupling top gusset panel 138 to roof panel 98.

Figure 7:
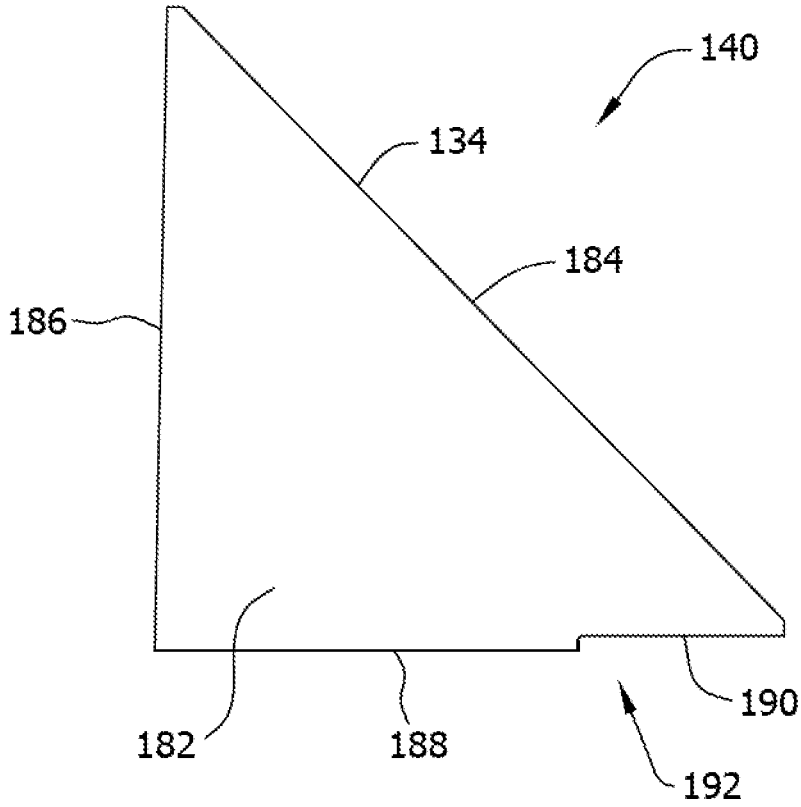

FIG. 7 is a perspective view of bottom gusset panel 140 shown in FIG. 4. Identical components shown in FIG. 7 are labeled with the same reference numbers used in FIG. 4. Referring to FIG. 4 and FIG. 7, in the exemplary embodiment, bottom gusset panel 140 includes a gusset sidewall 182 that extends between an outer surface 184, an inner surface 186, and a lower surface 188 to form bottom gusset panel 140 having a substantially triangular shape. Inner surface 186 is coupled to outer surface 170 of support member 136. Lower surface 188 is coupled to well panel 80. Outer surface 184 extends between inner surface 186 and lower surface 188 and at least partially defines inner surface 134 of support assembly 132. In one embodiment, lower surface 188 includes a recessed groove 190 defined in an outer portion 192 of lower surface 188. Recessed groove 190 is sized to receive a well panel support plate 194. Well panel support plate 194 is positioned between cargo assembly 15 and bottom gusset panel 140 to facilitate coupling bottom gusset panel 140 to cargo assembly 15. More specifically, well panel support plate 194 is coupled to front well panel 84 and rear well panel 86 at longitudinal boundary 96. Well panel support plate 194 includes a first member 196 coupled to front well panel 84 and a second member 198 coupled to rear well panel 86.

Figure 8:
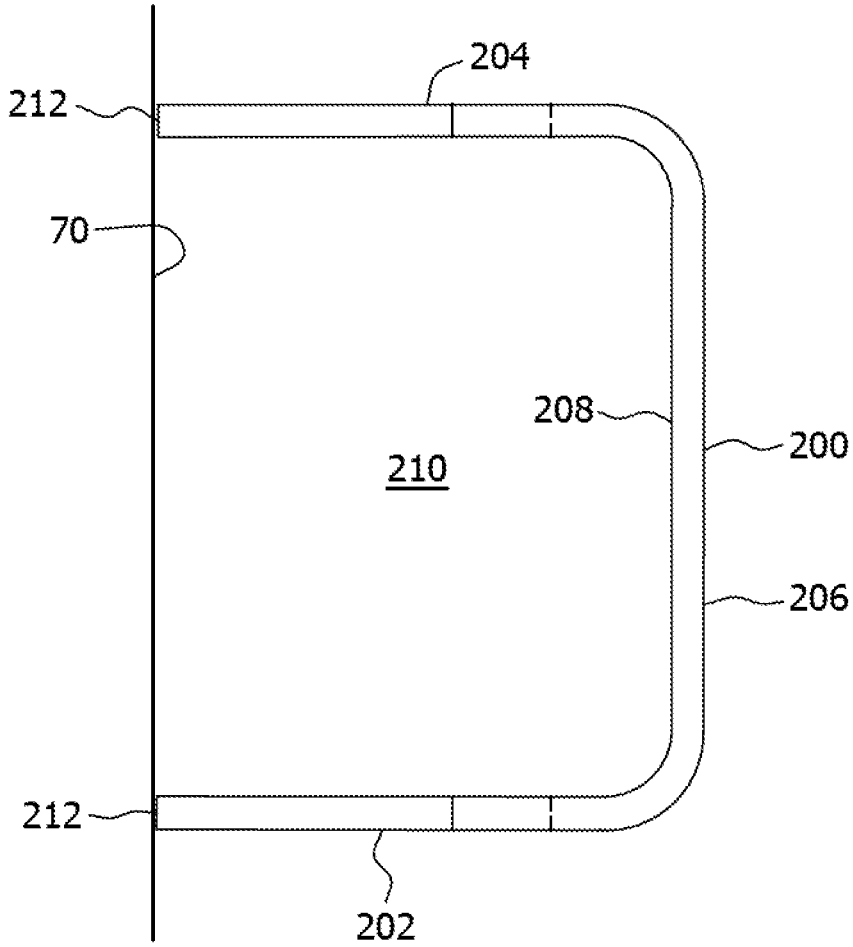
Figure 9:
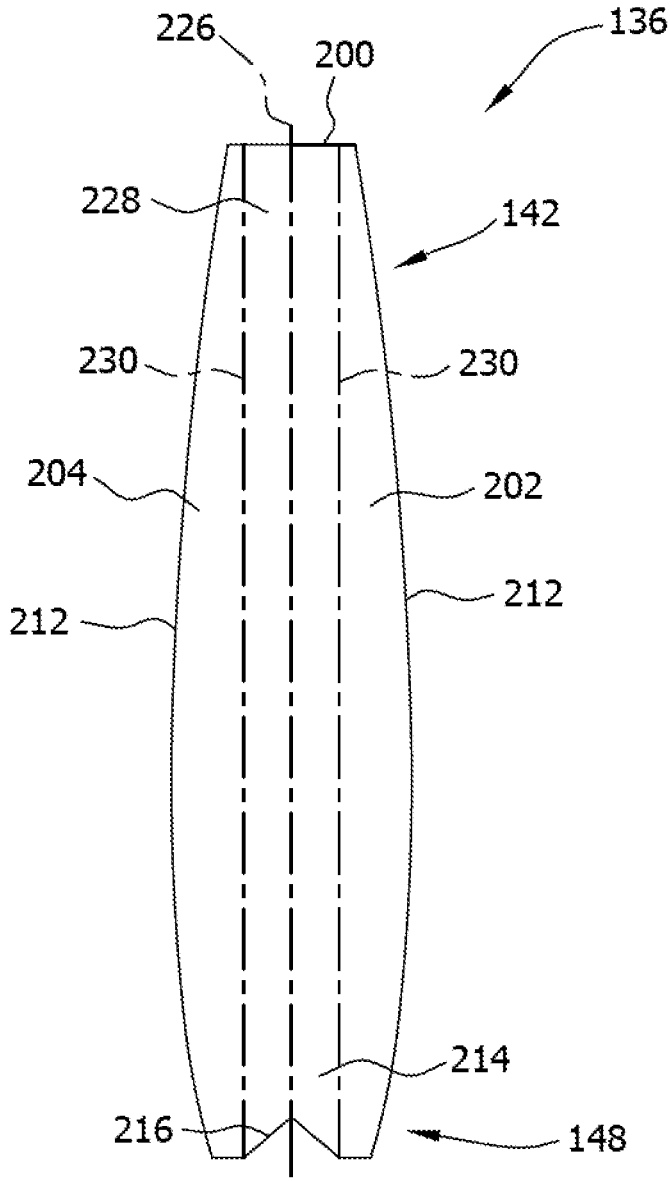

FIG. 8 is a partial cross-sectional view of support assembly 132 along sectional line 8-8 in FIG. 7. FIG. 9 is a perspective view of support assembly 132 shown in FIG. 4. Identical components illustrated in FIG. 8 and FIG. 9 are labeled with the same reference numbers used in FIG. 4. Referring to FIG. 5, FIG. 8, and FIG. 9, in the exemplary embodiment, support member 136 includes a base member 200, a first wing wall 202, and an opposing second wing wall 204. First wing wall 202 is coupled to or integrated with base member 200 and extends substantially perpendicularly outwardly from base member 200. Second wing wall 204 is coupled to or integrated with base member 200 and extends outwardly from base member 200 substantially parallel to first wing wall 202, such that first wing wall 202 and second wing wall 204 are in an opposing relationship. Base member 200 includes an outer surface 206 that at least partially defines support member outer surface 170 and interior volume 72. In the exemplary embodiment, first wing wall 202 and second wing wall 204 each extend from base member 200 such that support member 136 includes an interior surface 208 that at least partially defines a cavity 210. Support member 136 is coupled to sidewall inner surface 70 such that cavity 210 is defined between interior surface 208 and sidewall inner surface 70. First wing wall 202 and second wing wall 204 each include an outer edge 212 extending between support member upper portion 142 and support member lower portion 148. In one embodiment, outer edge 212 includes an arcuate shape. Outer edge 212 is coupled to sidewall inner surface 70, such that sidewalls 44 defines interior volume 72 having a substantially elliptical shape. In one embodiment, a lower section 214 of base member 200 includes a v-notch 216. V-notch 216 is sized to at least partially receive cargo assembly well panel 80.

More specifically, v-notch 216 is sized to receive front well panel 84 and rear well panel 86 at longitudinal boundary 96. In an alternative embodiment, v-notch 216 is sized to receive a connecting panel between front well panel 84 and rear well panel 86. Lower section 214 of base member 200 overlaps at least a portion of front well panel 84 and rear well panel 86. First wing wall 202 and second wing wall 204 each extend outwardly from lower portion 148 such that first wing wall 202 overlaps at least a portion of front well panel 84, and second wing wall 204 overlaps at least a portion of rear well panel 86. A reinforcement member 218 is coupled between an outer surface 220 of front well panel 84 and an outer surface 222 of rear well panel 86. Reinforcement member 218 is positioned between first wing wall 202 and second wing wall 204 and extends along transverse axis 122 of railway hopper car 10 between first sidewall 110 and second sidewall 112.

In the exemplary embodiment, first end 166 of top gusset panel 138 is coupled to outer surface 206 of base member 200. Inner surface 186 of bottom gusset panel 140 is coupled to outer surface 206 of base member 200. Top gusset panel 138 and bottom gusset panel 140 are each positioned along a vertical axis 224 defined between longitudinal boundary 96 and roof panel 98, such that top gusset panel 138 and bottom gusset panel 140 are substantially planar with longitudinal boundary 96. Base member 200 includes a centerline 226 defined between an upper section 228 and lower section 214. In one embodiment, base member 200 is coupled to cargo assembly 15 such that centerline 226 of base member 200 is substantially aligned with vertical axis 224. In the exemplary embodiment, support member 136 is formed as a unitary piece with first wind wall 202 and second wing wall 204 bent outwardly along bending lines 230. In an alternative embodiment, support member 136 is formed from a C-channel beam. In a further alternative embodiment, support member 136 is formed from an I-beam.

The above-described embodiments facilitate assembling a railway hopper car having a continuous cavity extending over a plurality of cargo wells. The above-described support system is a cost effective and efficient means to assemble a railway hopper car that facilitates unloading material with the use of a probe and reducing damage to the railway hopper car during unloading. The support system includes separate support assemblies coupled to opposite railcar sidewalls to define a continuous cavity that extends the length of the railway hopper car. As a result, the support assembly facilitates the use of a probe manipulated through each hopper compartment without requiring the probe to be removed from the railway hopper car.

Exemplary embodiments of a support system for a railcar and method of assembling the same are described above in detail. The support system and method are not limited to the specific embodiments described herein, but rather, components of apparatus and/or steps of the method may be utilized independently and separately from other components and/or steps described herein. For example, the support system may also be used in combination with other railway containers and methods, and are not limited to practice with only the railway hopper car and methods as described herein. Further, the exemplary embodiment can be implemented and utilized in connection with many other support system applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method of assembling a railway hopper car, said method comprising:

coupling first and second opposing sidewalls extending in a longitudinal direction to first and second opposing end walls extending in a transverse direction to form an upper portion of the hopper car, the sidewalls and the end walls including a top edge and a bottom edge;

coupling a plurality of well panels to the upper portion of the hopper car for forming a lower portion of the hopper car, the lower portion including a plurality of cargo wells, each of the well panels sloping inwardly from the bottom edge of the upper portion to a selectively openable floor, each cargo well of the plurality of cargo wells including at least one longitudinal boundary extending in the transverse direction and defined by an intersection of two well panels;

coupling a roof panel proximate to the top edge of the sidewalls and the end walls, the roof panel including an access opening extending longitudinally over at least a portion of each of the plurality of cargo wells;

coupling a first support assembly to an inner surface of the first sidewall and a second support assembly to an inner surface of the second sidewall proximate to a first longitudinal boundary of the at least one longitudinal boundary, each support assembly extending between the roof panel and the bottom edge of the sidewalls, the first support assembly being separate from the second support assembly;

coupling a first bottom gusset panel to a bottom portion of the first support assembly and at least one well panel of the plurality of well panels;

coupling a second bottom gusset panel to a bottom portion of the second support assembly and at least one well panel of the plurality of well panels;

coupling a first top gusset panel to a top portion of the first support assembly and the roof panel; and coupling a second top gusset panel to a top portion of the second support assembly and the roof panel.

2. A method in accordance with claim 1, wherein coupling a first support assembly further comprises:

coupling a first support member of the first support assembly to the inner surface of the first sidewall, the first support assembly extending from about the bottom edge of the first sidewall to about the roof panel;

coupling the first bottom gusset panel to a bottom portion of the first support member; and coupling the first top gusset panel to a top portion of the first support member.

3. A method in accordance with claim 2, wherein coupling a second support assembly further comprises:

coupling a second support member of the second support assembly to the inner surface of the second sidewall, the second support assembly extending from about the bottom edge of the second sidewall to about the roof panel;

coupling the second bottom gusset panel to a bottom portion of the second support member; and coupling the second top gusset panel to a top portion of the second support member.

4. A method in accordance with claim 3, further comprising coupling a first well panel support plate to a first well panel and a second well panel along a first longitudinal boundary, wherein coupling a first bottom gusset panel to at least one well panel of the plurality of well panels comprises coupling the first bottom gusset panel to the first well panel support plate, the first bottom gusset panel including a recessed groove sized to receive the first well panel support plate.

5. A method in accordance with claim 4, further comprising coupling a second well panel support plate to the first well panel and the second well panel along the first longitudinal boundary, wherein coupling a first bottom gusset panel to at least one well panel of the plurality of well panels comprises coupling the second bottom gusset panel to the second well panel support plate, the second bottom gusset panel including a recessed groove sized to receive the second well panel support plate.

6. A method in accordance with claim 5, further comprising coupling a reinforcement member to an outer surface of the first well panel and to an outer surface of the second well panel along the first longitudinal boundary, the reinforcement member positioned between outer edges of the first and second well panel support plates.

7. A method in accordance with claim 3, wherein:

coupling the first top gusset panel to the roof panel comprises coupling the first top gusset panel to the roof panel such that the first top gusset panel extends inwardly from the top portion of the first support member towards a first side of the access opening; and coupling the second top gusset panel to the roof panel comprises coupling the second top gusset panel to the roof panel such that the second top gusset panel extends from the top portion of the second support member towards a second side of the access opening.

8. A method in accordance with claim 7, wherein coupling the first top gusset panel to the roof panel further comprises positioning the first top gusset panel such that the first top gusset panel does not extend into an interior volume of the hopper car directly below the access opening.

9. A method in accordance with claim 8, wherein coupling the second top gusset panel to the roof panel further comprises positioning the second top gusset such that the second top gusset panel does not extend directly below the access opening.

10. A method in accordance with claim 7, further comprising:

coupling a first roof support plate between the first top gusset panel and the roof panel, the first top gusset panel including a recessed groove sized to receive the first roof support plate; and coupling a second roof support plate between the second top gusset panel and the roof panel, the second top gusset panel including a recessed groove sized to receive the second roof support plate.

11. A support system for a railway hopper car, the railway hopper car including an upper portion, a lower portion coupled to the upper portion, and a roof panel coupled to a top section of the upper portion, the upper portion including a first sidewall and an opposing second sidewall extending in the longitudinal direction, the first and second sidewalls coupled between a first end wall and an opposing second end wall, the first and second end walls extending in the transverse direction, the lower portion including a plurality of cargo wells including a plurality of inwardly sloping well panels, each cargo well of the plurality of cargo wells including at least one longitudinal boundary extending in the transverse direction and defined by the intersection of two well panels, the roof panel including an access opening extending longitudinally over at least a portion of each of the plurality of cargo wells, said support system comprising:

a first support assembly coupled to an inner surface of the first sidewall of the hopper car;

a second support assembly coupled opposite said first support assembly to an inner surface of the second sidewall of the hopper car, wherein said first support assembly and said second support assembly are separate from one another;

a first bottom gusset panel coupled to a bottom portion of said first support assembly and at least one well panel of the plurality of well panels;

a second bottom gusset panel coupled to a bottom portion of said second support assembly and at least one well panel of the plurality of well panels;

a first top gusset panel coupled to a top portion of said first support assembly and the roof panel; and a second top gusset panel coupled to a top portion of said second support assembly and the roof panel.

12. A support system in accordance with claim 11, wherein said first support assembly comprises:

a first support member coupled to the inner surface of the first sidewall, said first support member extending between the roof panel and a bottom of the first sidewall;

said first top gusset panel coupled to a top portion of said first support member; and said first bottom gusset panel coupled to a bottom portion of said first support member.

13. A support system in accordance with claim 12, further comprising a first well panel support plate coupled to a first well panel and a second well panel along a first longitudinal boundary, said first bottom gusset panel coupled to said first well panel support plate, said first bottom gusset panel comprising a recessed groove sized to receive said first well panel support plate.

14. A support system in accordance with claim 12, wherein said second support assembly comprises:

a second support member coupled to the inner surface of the second sidewall, said second support member extending between the roof panel and a bottom of the second sidewall;

said second top gusset panel coupled to a top portion of said second support member; and said second bottom gusset panel coupled to a bottom portion of said second support member.

15. A support system in accordance with claim 14, wherein said first top gusset panel extends inwardly from said first support member towards a first side of the access opening, wherein no portion of said first top gusset panel extends directly below the access opening.

16. A support system in accordance with claim 15, wherein said second top gusset panel extends inwardly from said second support member towards a second side of the access opening opposite the first side, wherein no portion of said second top gusset panel extends directly below the access opening.

17. A support system in accordance with claim 16, further comprising:

a first roof support plate coupled between said first top gusset panel and the roof panel, said first top gusset panel comprising a recessed groove defined in a top surface of said first top gusset panel, said recessed groove sized to receive said first roof support plate; and a second roof support plate coupled between said second top gusset panel and the roof panel, said second top gusset panel comprising a recessed groove defined in a top surface of said second top gusset panel, said recessed groove sized to receive said second roof support plate.

18. A support system in accordance with claim 14, wherein each of said first and second support members comprises a base, a first wing wall, and an opposing second wing wall, each of said first wing wall and said second wing wall extending outwardly from said base towards the respective sidewall inner surface to define a cavity therebetween, said base comprising a v-notch groove defined in a lower portion of said base, the v-notch groove sized to receive at least a portion of a first well panel and a second well panel at an intersection of the first well panel and the second well panel, each of said first wing wall and said second wing wall comprising an arcuate end edge for coupling to the respective sidewall inner surface.

19. A support system in accordance with claim 11, wherein no portion of said first support assembly or said second support assembly extends directly below the access opening.

20. A support system in accordance with claim 11, wherein the upper portion, the lower portion, and the roof panel define an interior volume of the hopper car, wherein a first hopper compartment is at least partially defined by a portion of the first and second sidewalls, the first end wall, a portion of the roof panel, a first cargo well of the plurality of cargo wells, and a first longitudinal boundary of the at least one longitudinal boundary, wherein a second hopper compartment is at least partially defined by a portion of the first and second sidewalls, a portion of the roof panel, a second cargo well of the plurality of cargo wells, and the first longitudinal boundary, and wherein the interior volume extends continuously from the first hopper compartment to the second hopper compartment.

21. A support system in accordance with claim 20, further comprising a passageway extending between the first hopper compartment and the second hopper compartment that is at least partially defined by said first support assembly and said second support assembly.

22. A railway hopper car comprising:

a first sidewall and a second opposing sidewall coupled between a first end wall and a second opposing end wall to form an upper portion of said hopper car, said first and second sidewalls extending in a longitudinal direction, said first and second opposing end walls extending in a transverse direction, said sidewalls and said end walls including a top edge and a bottom edge;

a plurality of cargo wells coupled together to form a lower portion of said hopper car, said upper portion coupled to said lower portion to form said hopper car, each cargo well of said plurality of cargo wells comprising a plurality of well panels sloping inwardly from the bottom edge of said upper portion to a selectively openable floor, each cargo well of said plurality of cargo wells including at least one longitudinal boundary extending in the transverse direction and defined by an intersection of two well panels;

a roof panel coupled to the top edge of said sidewalls and said end walls, said roof panel including an access opening extending longitudinally over at least a portion of each of said plurality of cargo wells;

at least one first support assembly coupled to an inner surface of said first sidewall, each of said at least one first support assembly extending between the top edge and the bottom edge of said first sidewall;

at least one second support assembly coupled to an inner surface of said second sidewall, each of said at least one second support assembly extending between the top edge and the bottom edge of said second sidewall, said second support assembly separate from said first support assembly;

a first bottom gusset panel coupled to a bottom portion of said first support assembly and at least one well panel of said plurality of well panels;

a second bottom gusset panel coupled to a bottom portion of said second support assembly and at least one well panel of said plurality of well panels;

a first top gusset panel coupled to a top portion of said first support assembly and said roof panel; and a second top gusset panel coupled to a top portion of said second support assembly and said roof panel.

23. A railway hopper car in accordance with claim 22, wherein said first and second support assemblies are positioned proximate to a first longitudinal boundary of said at least one longitudinal boundary.

24. A railway hopper car in accordance with claim 22, wherein each first support assembly of said at least one first support assembly comprises:

a first support member coupled to said inner surface of said first sidewall, said first support member extending between said roof panel and the bottom edge of said first sidewall;

said first top gusset panel coupled to a top portion of said first support member; and said first bottom gusset panel coupled to a bottom portion of said first support member.

25. A railway hopper car in accordance with claim 24, wherein said first top gusset panel comprises a first outer edge positioned a distance from a first side of said access opening such that said first top gusset panel does not extend directly below said access opening.

26. A railway hopper car in accordance with claim 22, wherein each second support assembly of said at least one second support assembly comprises:

a second support member coupled to said inner surface of said second sidewall, said second support member extending between said roof panel and the bottom edge of said second sidewall;

said second top gusset panel coupled to a top portion of said second support member; and said second bottom gusset panel coupled to a bottom portion of said second support member.

27. A railway hopper car in accordance with claim 26, wherein said second top gusset panel comprises a second outer edge positioned a distance from a second side of said access opening such that said second top gusset panel does not extend directly below said access opening.

28. A railway hopper car in accordance with claim 22, wherein no portion of said first support assembly or said second support assembly extends directly below the access opening.

29. A railway hopper car in accordance with claim 22, wherein said upper portion, said lower portion, and said roof panel define an interior volume of said hopper car, wherein a first hopper compartment is at least partially defined by a portion of said first and second sidewalls, said first end wall, a portion of said roof panel, a first cargo well of said plurality of cargo wells, and a first longitudinal boundary of said at least one longitudinal boundary, wherein a second hopper compartment is at least partially defined by a portion of said first and second sidewalls, a portion of said roof panel, a second cargo well of said plurality of cargo wells, and said first longitudinal boundary, and wherein the interior volume extends continuously from said first hopper compartment to said second hopper compartment.

30. A railway hopper car in accordance with claim 29, further comprising a passageway extending between said first hopper compartment and said second hopper compartment that is at least partially defined by said first support assembly and said second support assembly.

31. A railway hopper car comprising:

an upper portion comprising a first sidewall, an opposing second sidewall, a first end wall, and an opposing second end wall;

a lower portion coupled to said upper portion, said lower portion comprising at least two cargo wells and a longitudinal boundary extending between the at least two cargo wells, each cargo well including a selectively openable floor, wherein said upper and lower portions define an interior volume of said hopper car;

a roof panel coupled to a top edge of said sidewalls and said end walls, said roof panel including an access opening extending longitudinally over at least a portion of the at least two cargo wells;

a first support assembly coupled to an inner surface of said first sidewall, said first support assembly extending between the top edge and a bottom edge of said first sidewall, said first support assembly positioned proximate to the longitudinal boundary, wherein said first support assembly is configured to only partially extend into the interior volume of the hopper car;

a first bottom gusset panel coupled to a bottom portion of said first support assembly;

a second bottom gusset panel coupled to a bottom portion of said second support assembly;

a first top gusset panel coupled to a top portion of said first support assembly and said roof panel; and a second top gusset panel coupled to a top portion of said second support assembly and said roof panel.

32. A railway hopper car in accordance with claim 31, wherein no portion of said first support assembly extends directly below the access opening.

33. A railway hopper car in accordance with claim 31, wherein a first hopper compartment is at least partially defined by a portion of said first and second sidewalls, said first end wall, a portion of said roof panel, a first cargo well of at least two cargo wells, and the longitudinal boundary, wherein a second hopper compartment is at least partially defined by a portion of said first and second sidewalls, a portion of said roof panel, a second cargo well of the at least two cargo wells, and the longitudinal boundary, and wherein said interior volume extends continuously from said first hopper compartment to said second hopper compartment.

34. A railway hopper car in accordance with claim 33, further comprising a passageway extending between the first hopper compartment and the second hopper compartment that is at least partially defined by said first support assembly.

* * * * *